US010980388B2

(12) United States Patent
Crowell et al.

(10) Patent No.: US 10,980,388 B2
(45) Date of Patent: Apr. 20, 2021

(54) HAND HELD ROTARY CLEANING TOOL INCLUDING LIQUID DISPENSER

(71) Applicant: Robert Bosch GmbH, Stuttgart (DE)

(72) Inventors: Christopher Crowell, Chicago, IL (US); Jeremy Rubens, Palatine, IL (US)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/443,420

(22) Filed: Jun. 17, 2019

(65) Prior Publication Data

US 2020/0390311 A1 Dec. 17, 2020

(51) Int. Cl.
*A47L 11/40* (2006.01)

(52) U.S. Cl.
CPC ..... *A47L 11/4088* (2013.01); *A47L 11/40* (2013.01); *A47L 11/4038* (2013.01); *A47L 11/4077* (2013.01); *A47L 11/4083* (2013.01)

(58) Field of Classification Search
CPC .. A47L 11/40; A47L 11/4038; A47L 11/4077; A47L 11/4083; A47L 11/4088
See application file for complete search history.

(56) References Cited

U.S. PATENT DOCUMENTS 3,099,028 A 7/1963 Ardito
3,101,505 A * 8/1963 Belicka ..... A47L 11/30 15/320
3,396,417 A 8/1968 Starr
3,462,889 A 8/1969 Erickson
3,688,139 A * 8/1972 Yaguchi ..... B27B 9/00 310/50
4,796,321 A 1/1989 Lee
5,657,503 A * 8/1997 Caruso ..... A47L 11/03 15/97.1
7,225,503 B1 6/2007 Lenkiewicz et al.
7,363,673 B2 4/2008 Schonewille et al.
10,040,226 B2 8/2018 Benson
2017/0368663 A1 12/2017 Yang et al.
2018/0078973 A1 3/2018 Yano et al.

FOREIGN PATENT DOCUMENTS

DE 7625647 9/1978
DE 19819640 11/1999
DE 10134448 12/2002
EP 1175848 1/2002
FR 2262561 4/1974
WO 9729664 8/1997

* cited by examiner

*Primary Examiner* — Randall E Chin
(74) *Attorney, Agent, or Firm* — Kelly McGlashen; Maginot, Moore & Beck LLP

(57) ABSTRACT

A hand-held rotary cleaning tool includes a housing that encloses an electric motor and a gear set that connects the motor to an output shaft. The rotary cleaning tool includes at least one cleaning accessory that is detachably connected to the output shaft, and a flexible splash guard. The splash guard surrounds the output shaft and cleaning accessory so as to prevent liquid splash during tool use. The rotary cleaning tool also includes a reservoir for storing a liquid cleaning solution, and a liquid delivery line that delivers liquid from the reservoir to the space enclosed by the splash guard.

19 Claims, 7 Drawing Sheets

HAND HELD ROTARY CLEANING TOOL INCLUDING LIQUID DISPENSER

BACKGROUND

In general, rotary power tools are light-weight, handheld power tools capable of being equipped with a variety of accessory tools and attachments, such as cutting blades, sanding discs, grinding tools, and many others. A rotary cleaning tool is a rotary power tool that facilitates cleaning and includes accessories such as brushes, scrubbing pads and polishing pads, as well as a splash guard that prevents liquid splash during tool use.

Some handheld rotary cleaning tools may include a housing that serves as a handle for the tool and as an enclosure for an electric motor and a battery that supplies power to the electric motor. The electric motor drives an output shaft to rotate at high speeds. The output shaft is equipped with an accessory attachment mechanism that enables a cleaning accessory to be releasably secured to the tool. In addition, the tool includes a splash guard attachment mechanism that enables the splash guard to be releasably secured to the power tool.

When load is applied to the output shaft, electric current supplied to the motor increases. Some battery-powered rotary cleaning tools are configured to stall the motor in the event of an excessive current in order to protect the motor and battery. If the splashguard is flexible, it may fold in and interfere with the cleaning accessory or the output shaft. Under certain circumstances, such interference can increase load to an extent that stall occurs and/or battery life is decreased. Thus it may be desirable to provide a flexible splashguard that does not induce stall or reduce battery life.

SUMMARY

In some aspects, a hand-held rotary cleaning tool includes a housing, and a motor disposed in the housing. The motor is configured to rotate an output shaft about a rotational axis, and the output shaft protrudes from the housing. The tool includes a splash guard that is supported on the housing so as to surround a protruding portion of the output shaft, and a reservoir that is configured to receive a liquid. The reservoir supported on the housing. In addition, the tool includes a liquid delivery line that extends between the reservoir and the splashguard. The liquid delivery line provides a fluid path from the reservoir to the splash guard.

In some embodiments, the tool includes a connector that is configured to secure a cleaning accessory to the output shaft, and the connector has features that direct liquid received from the liquid delivery line to the cleaning accessory.

In some embodiments, the features that direct liquid received from the liquid delivery line to the cleaning accessory include ridges that protrude from a tool-facing surface of the connector. The ridges are spaced apart, and each ridge is aligned with a radius of the rotational axis.

In some embodiments, the features that direct liquid received from the liquid delivery line to the cleaning accessory include a through-opening provided in the connector.

In some embodiments, the features that direct liquid received from the liquid delivery line to the cleaning accessory include a rim that protrudes from a tool-facing surface of the connector and extends about a periphery of the tool-facing surface.

In some embodiments, the connector comprises a base, a stem and a through-opening. The base has a tool-facing surface, an accessory-facing surface that is opposed to the tool-facing surface, and a peripheral edge that extends between the tool-facing surface and the accessory facing surface. The stein is hollow and protrudes from a center of the tool-facing surface. The stem is shaped and dimensioned to receive and engage the output shaft. The through-opening is disposed between the stem and the peripheral edge, the through-opening extending between the tool-facing surface and the accessory-facing surface of the base.

In some embodiments, the connector comprises a pair of protruding ridges that extend between the stem and the peripheral edge, and the through-opening is disposed between the pair of ridges.

In some embodiments, the connector comprises a rim that protrudes toward the tool from the tool-facing surface of the base. The rim extends along the peripheral edge of the base, and the through-opening is located closer to the rim than to the stein.

In some embodiments, the through-opening is located adjoining the rim.

In some embodiments, the tool includes the cleaning accessory, and the cleaning accessory is secured to the accessory-facing surface of the base. In addition, the cleaning accessory includes a through hole that is aligned with the through-opening.

In some embodiments, the liquid delivery line includes a first end that opens into the reservoir, and a second end that is opposed to the first end. The second end is disposed in the splash guard in such a way that liquid discharged from the second end is directed toward the rotational axis.

In some embodiments, the reservoir is stupported on an outer surface of the housing.

In some embodiments, the reservoir is a flexible bladder.

In some embodiments, the reservoir is a flexible bladder that is sized and shaped to be grasped in a user's hand, and includes a pressure relief valve disposed at the interface with the liquid deliver line. The pressure relief valve is normally closed. The pressure relieve valve opens to allow liquid to move from the reservoir to the liquid delivery line when an internal pressure of the reservoir exceeds a predetermined pressure.

In some embodiments, the liquid delivery line includes a first end that opens into the reservoir, and a second end that is opposed to the first end. The second end is secured in an opening in the splash guard.

In some embodiments, the second end of the liquid delivery lisle protrudes into the space enclosed by the splash guard and opens facing, the output shaft.

In some embodiments, the liquid delivery line includes a first end that opens into the reservoir, and a second end that is opposed to the first end. The second end is disposed in the splash guard in such a way that liquid discharged from the second end is directed toward the rotational axis.

In some embodiments, the reservoir is disposed inside the housing.

In some aspects, a handheld rotary cleaning tool includes a housing that serves as a handle for the tool and as an enclosure for an electric motor and a battery that supplies power to the electric motor. The electric motor drives an output shaft to rotate at high speeds. The output shaft is equipped with an accessory connector that enables a cleaning accessory to be releasably secured to the tool. The tool includes a flexible splash guard that surrounds the output shaft and cleaning accessory. In addition, the tool includes a reservoir for storing a liquid such as a cleaning solution, and liquid delivery line that delivers the liquid to the space enclosed by the splash guard. In particular, the liquid delivery line is received in an opening in the splash guard, permitting liquid to be dispensed directly into the enclosed space. The tool is configured so that the liquid is trapped between the splash guard and the surface to be cleaned. Since the liquid is contained within the splash guard, liquid splash during tool use is prevented.

In some embodiments, the liquid line directs the dispensed liquid toward the connector. In some embodiments, the connector and cleaning accessory are configured to receive the liquid dispensed from the liquid delivery line and direct it to the cleaning surface of the cleaning accessory. The liquid is received on the tool-facing surface of the connector. Although the tool, as it rotates, generates centrifugal forces that direct the liquid on the connector tool-facing surface radially outward alone the tool-facing surface toward the splash guard, the tool-facing surface includes structures that prevent the liquid from spraying off and directs if toward openings in the connector. The structures may include radial ribs and/or a peripheral rim. The openings in the connector allow liquid to flow into the rear side of the cleaning accessory and be directed to the cleaning surface of the accessory under force of gravity.

In some embodiments, the cleaning accessory includes through holes that are aligned with the openings in the connector. In use, the liquid is directed into the openings in the connectors, and then flows through the through holes and onto the surface to be cleaned.

In some embodiments, the splash guard is flexible and has the shape of a truncated, hollow cone. A proximal end of the splash guard is connected to the tool housing, and the opposed, distal end of the splash guard may contact the surface to be cleaned. When the tool is not in use, a cap may be connected to the distal end of the splash guard. Advantageously, the cap can be used to seal and store the cleaning accessory (i.e., a polishing pad) after use, whereby the wet tool is enclosed and drips are prevented.

BRIEF DESCRIPTION OF THE FIGURES

In FIG. 2, the battery, motor and gear set are shown schematically.

DETAILED DESCRIPTION

Figure 1:
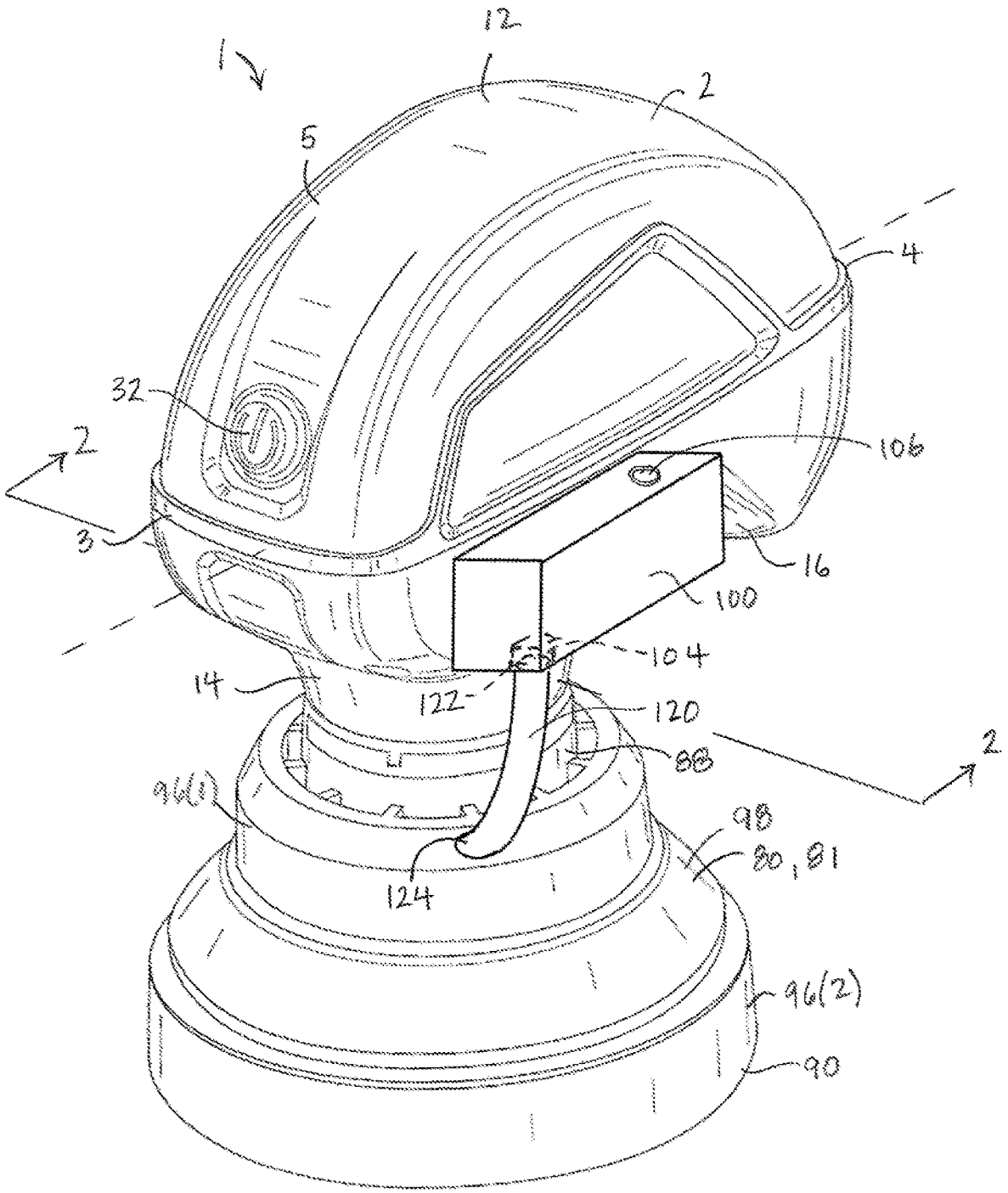
FIG. 1 is a left side perspective view of a handheld rotary cleaning tool including a reservoir, a flexible splash guard, and liquid delivery line that delivers liquid from the reservoir to the splash guard.
Figure 2:
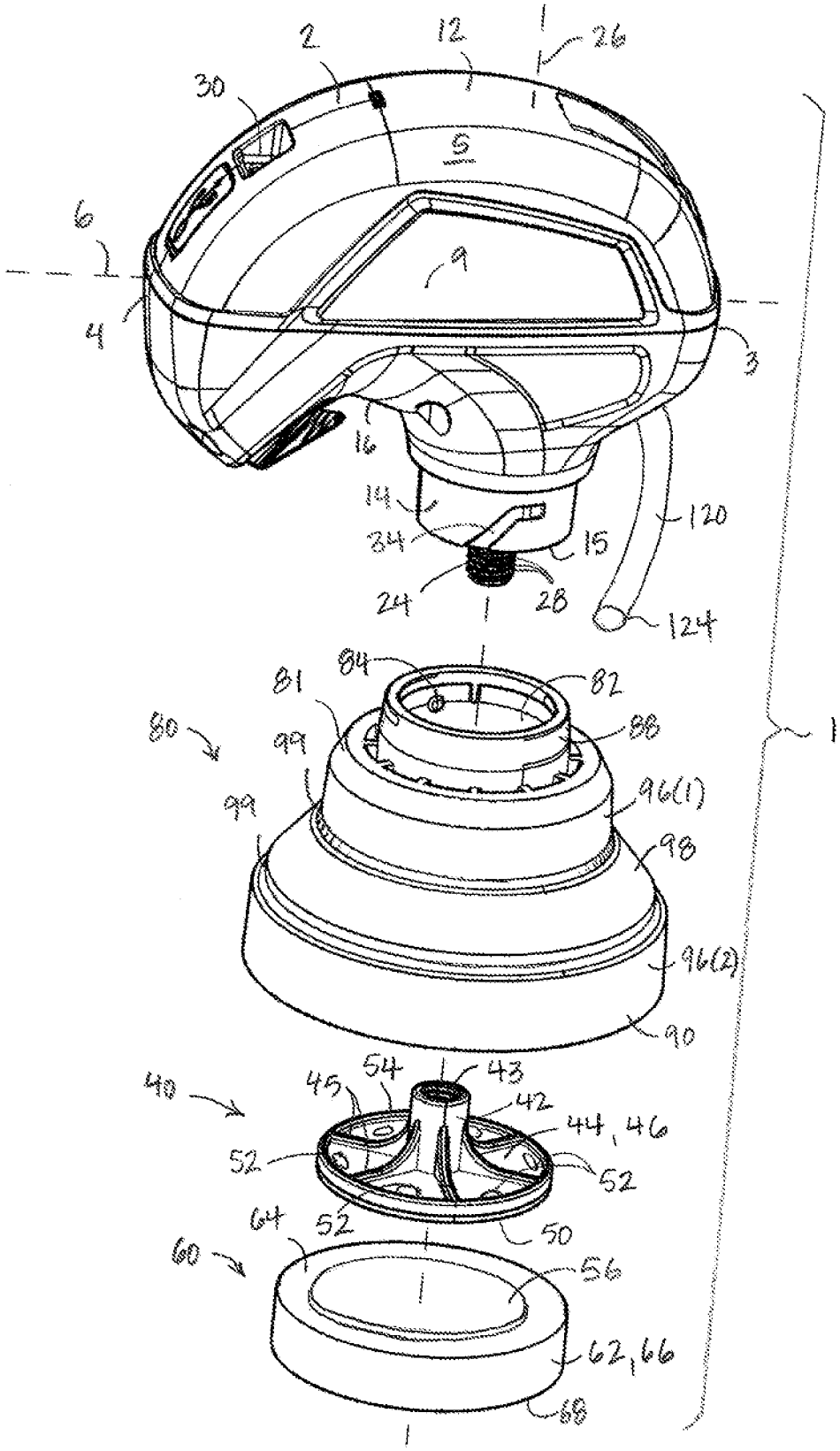
FIG. 2 is right side perspective and exploded view of the handheld rotary cleaning tool of FIG. 1.
Figure 3:
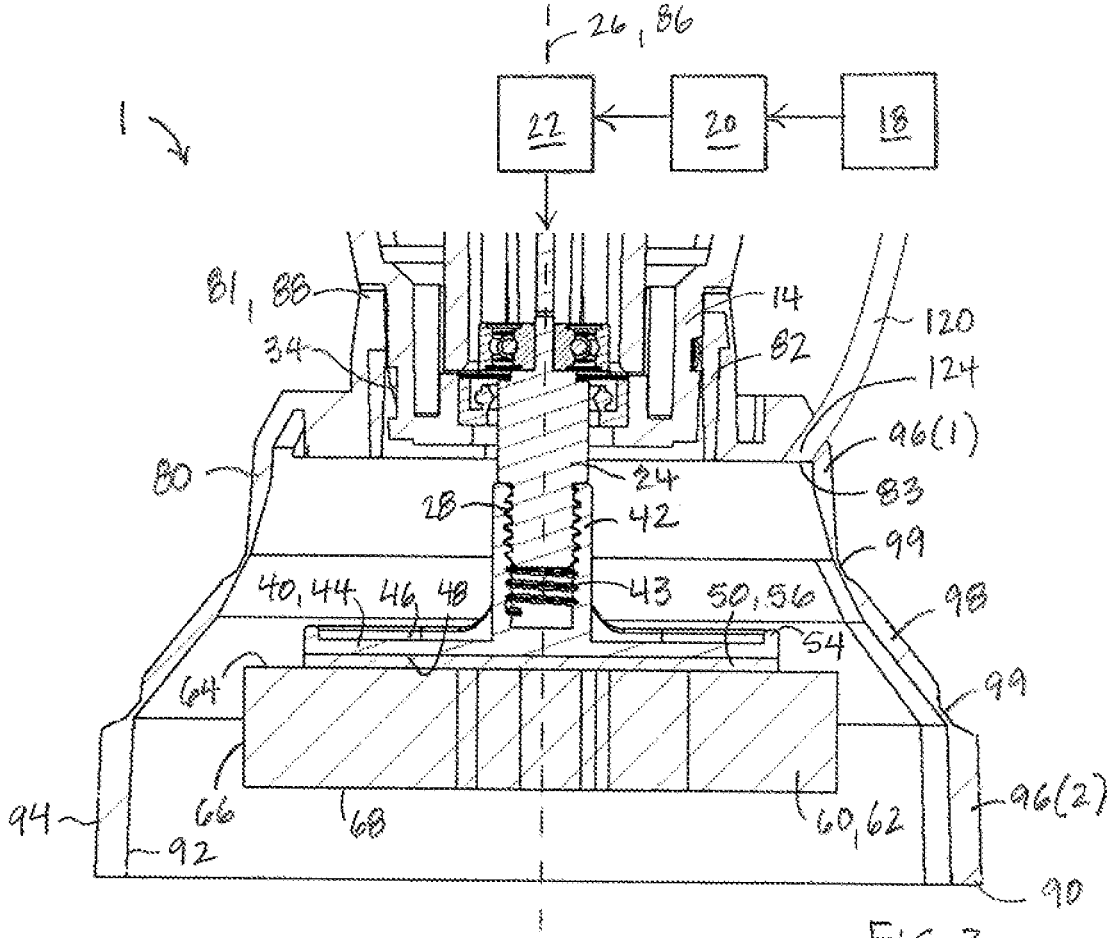
FIG. 3 is a cross-sectional view of a portion of the handheld rotary cleaning tool of FIG. 1 as seen along line 2-2 of FIG. 1.
Figure 4:
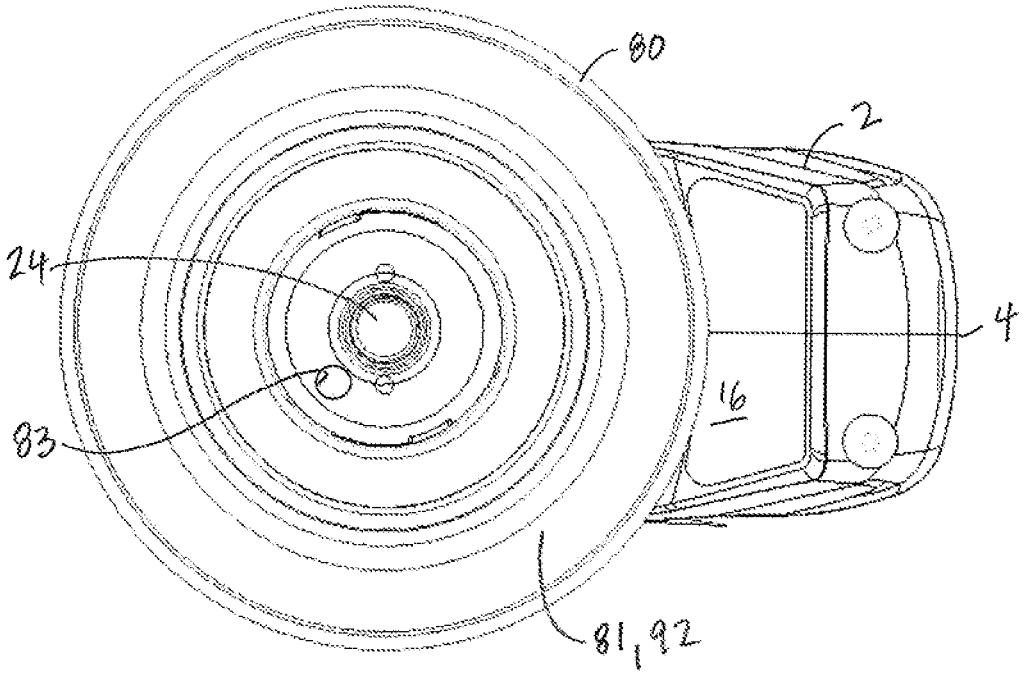
FIG. 4 is a bottom side view of the handheld rotary cleaning tool of FIG. 1, with the connector and cleaning accessory omitted to permit visualization of the inner surface of the splash guard.
Figure 5:
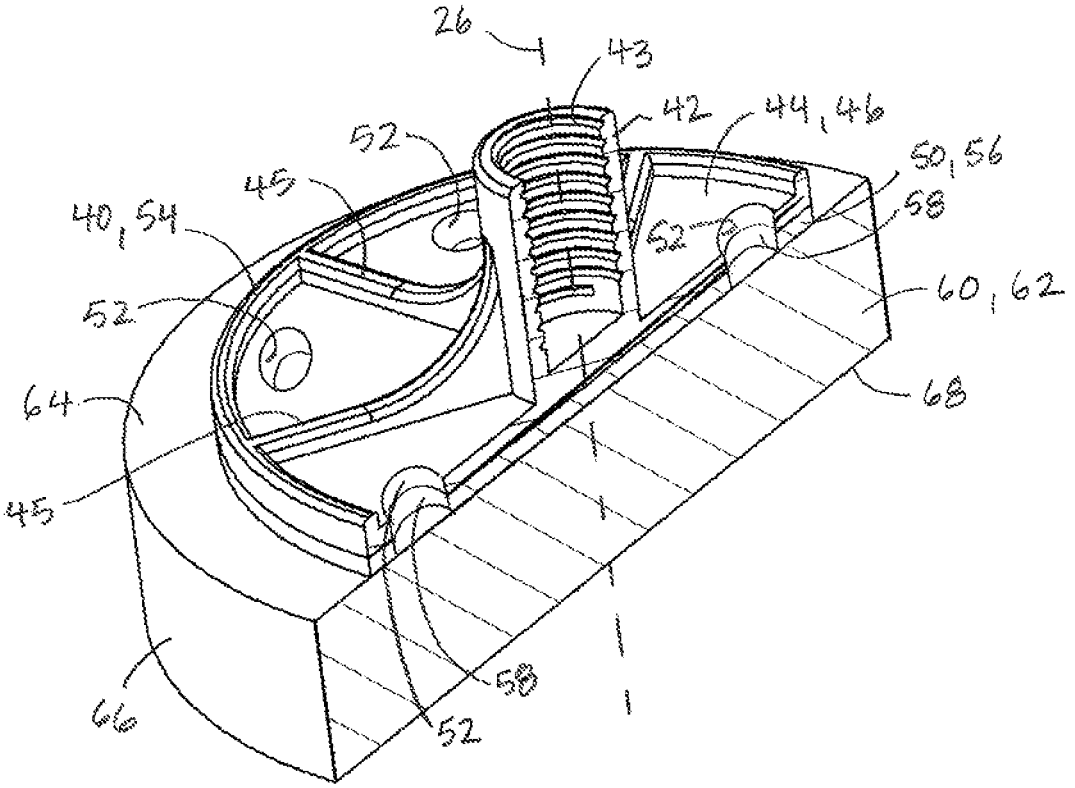
FIG. 5 is a perspective cross-sectional view of the connector and the cleaning accessory of FIG. 2.

Referring now to FIGS. 1-5, a rotary cleaning tool 1 is a hand-held rotary power tool that facilitates cleaning. The rotary cleaning tool 1 includes a housing 2 that encloses an electric motor 20 and a gear set 22 that connects the motor 20 to an output shaft 24 of the tool 1. The rotary cleaning tool 1 includes at least one cleaning accessory 60 that is detachably connected to the output shaft 24, as discussed below. In addition, the rotary cleaning tool 1 includes a flexible splash guard 80 that surrounds the output shaft 24 and the cleaning accessory 60 so as to prevent liquid splash during tool use. In addition, the tool 1 includes a reservoir 100 for storing a liquid such as a cleaning solution, and a liquid delivery line 120 that delivers the liquid to the splash guard 80. In particular, the liquid delivery line 120 is received in an opening 83 in the splash guard 80, permitting liquid to be dispensed directly into the space enclosed by the splash guard 80, as discussed in detail below.

The housing 2 serves as a handle 5 of the tool 1, and is shaped and dimensioned to permit the tool 1 to be hand held. As used herein, the term "hand held" refers to a housing having a shape that permits holding by a human hand, and a size and weight that permits the tool 1 to be easily lifted, manipulated and operated by the human hand. In the illustrated embodiment, the housing 2 generally has an ellipsoid shape. The housing 2 is elongated along a major axis 6, and includes a convex portion 12 that faces a palm of a user when the tool 1 is in use. The housing 2 includes a nose portion 14 that surrounds a portion of the output shaft 24 and protrudes in a direction away from the convex portion 12. More particularly, the nose portion 14 protrudes in a direction that is perpendicular to the major axis 6, and is disposed between a midpoint 9 of the major axis 6 and a first end 3 of the housing 2 (e.g., a "front end" of the housing 2). The housing 2 also includes a concavity 16 that is disposed between the midpoint 9 of the major axis 6 and a second end 4 of the housing 2 (e.g., a "rear end" of the housing 2), where the housing second end 4 is opposed to the housing first end 3. The concavity 16 provides a grip that may be grasped by the fingers of a user when the tool 1 is in use.

The housing 2 may be constructed of a rigid material such as plastic, metal, or composite materials such as a fiber reinforced polymer. The housing 2 encloses the electric motor 20 and the gear set 22. The output shaft 24 is driven to rotate about a rotational axis 26 by the motor 20 via the gear set 22, and a portion of the output shaft 24 protrudes from the housing 2. The gear set 22 is configured so that the output shaft 24 rotates at a reduced rotational speed relative to the output of the motor 20. The housing 2 also encloses a battery 18 that provides power to the motor 20. In some embodiments, the battery 18 may be recharged via an electrical connector 30 supported on the convex portion 12 adjacent to the housing second end 4. Power to the motor 20 is controlled by a power switch 32 provided on the convex portion 12 adjacent to the housing first end 3.

An outer surface of the nose portion 14 includes features that allow it to mechanically engage with corresponding features of the splash guard 80 and retain the splash guard 80 on the housing 2. For example, in the illustrated embodiment, the outer surface of the nose portion 14 includes a retaining groove 34 disposed on each of opposed sides of the nose portion 14. The retaining grooves 34 open at the terminal end 15 of the nose portion 14, and generally extends along a tortuous path toward the handle 5 and along a circumference of the nose portion 14. The retaining grooves 34 each receive and retain corresponding a bump 84 that protrudes from the splash guard 80, as discussed further below.

The rotational axis 26 of the output shaft 24 is perpendicular to the major axis 6. In addition, the rotational axis 26 intersects the major axis 6 at a location between the midpoint 9 of the major axis 6 and the tool first end 3. The output shaft 24 protrudes from the terminal end 15 of the nose portion 14, and the portion of the output shaft 24 that protrudes from the nose portion 14 includes features that allow it to mechanically engage corresponding features of a connector 40. For example, in the illustrated embodiment, the output shaft 24 has an external thread 28 that engages, and forms a mechanical connection with, corresponding internal threads 43 of the connector 40, as discussed further below.

The splash guard 80 is secured to the housing nose portion 14, and depends from the housing nose portion 14 in such a way as to surround the protruding portion of the output shaft 24, the connector 40 and the cleaning accessory 60. As a result, the splash guard 80 is configured to prevent liquid splash during use of the tool 1. The splash guard 80 includes a splash guard body 81, and a rigid collar 82 disposed at a proximal end 88 of the splash guard body 81.

The splash guard body 81 is a hollow, flexible member having a thin wall of non-uniform diameter. For example, the splash guard body 81 has the general shape of a truncated cone. The proximal end 88 of the splash guard body 81 is the end closest to the housing 2, and is dimensioned to surround the housing nose portion 14 with a tolerance fit. The distal end 90 of the splash guard body 81 is opposed to the proximal end 88, and a diameter of the distal end 90 is greater than the diameter of the proximal end 88. A longitudinal axis 86 of the splash guard body 81 extends between the proximal and distal ends 88, 90 and is co-axial with the rotational axis 26. The distal end 90 surrounds, and is radially spaced apart from, a periphery 66 of the cleaning accessory 60. Here, the term "radial" refers a direction with respect to the longitudinal axis 86. In the illustrated embodiment, a cleaning surface 68 of the cleaning accessory 60 is recessed relative to the splash guard distal end 90. However, in other embodiments, the cleaning surface 68 may be flush with the splash guard distal end 90.

The splash guard proximal end 88 is detachably connected to the housing nose portion 14 via the collar 82. The collar 82 is fixed to an inner surface of the splash guard proximal end 88. An inner surface of the collar 82 includes a pair of diametrically opposed bumps 84. Each bump 84 is a shallow, rounded protrusion that is received in a corresponding retaining groove 34 of the nose portion 14, and the bumps 84 cooperate with the grooves 34 to retain the splash guard 80 on the housing nose portion 14.

The splash guard body 81 is formed of a flexible plastic material. In particular, the splash guard body 81 is sufficiently flexible to deform radially inward when the splash guard 80 is pressed against an external object such as a wall. This flexibility allows the distance between the cleaning accessory periphery 66 and the splash guard 80 to be reduced, which in turn allows the cleaning accessory 60 to be positioned close to the external object (i.e., the wall) during cleaning. In addition, the splash guard body 81 is sufficiently flexible to deform longitudinally. To this end, the splash guard body 81 includes two annular regions 96(1), 96(2) that are spaced apart along, and centered on the longitudinal axis 86. The first annular region 96(1) has a diameter that is greater than the diameter of the collar 82 and less than the diameter of the second annular region 96(2). The second annular region 96(2) includes the distal end 90. The annular regions 96(1), 96(2) are joined together via a longitudinally-tapering intervening region 98 that is disposed between the two annular regions 96(1), 96(2). The thickness of the splash guard body 81 is reduced at the intersections between the intervening region 98 and each of the first and second annular regions 96(1), 96(2), and these reduced-thickness portions 99 enable folding of the splash guard body 81 at the reduced-thickness portions 99. By this configuration, the splash guard body 81 is collapsible along the longitudinal axis 86 by folding the splash guard body 81 at the reduced-thickness portions 99 so that the first and second annular regions 96(1), 96(2) are concentric and radially aligned. When the splash guard 80 is in a collapsed configuration, the output shaft 24 is easily accessible and it becomes easy to exchange cleaning accessories 60.

The tool 1 includes the reservoir 100 for storing a liquid, and the liquid delivery line 120 that delivers the liquid to the splash guard 80. The reservoir 100 is supported on an outer surface of the housing 2. For example, in some embodiments, the reservoir 100 is detachably secured to the surface of the housing 2 via hook and loop fastener (not shown). In other embodiments, the housing 2 includes an elastic bracket (not shown) that is configured to secure the reservoir 100 to the housing and to allow the reservoir 100 to be detached from the housing 2 for filling.

The reservoir 100 is a flexible bladder that is sized and shaped to be grasped in a user's hand. The reservoir 100 includes a fill opening 106 that is provided on an upper surface of the reservoir 100, and a discharge opening 108 that is provided on a lower surface of the reservoir 100. Directional terms, such, as "upper" and "lower" are used herein with reference to the orientation of the tool 1 shown in FIG. 1 for purposes of description, and are not intended to be limiting. The reservoir 100 includes a pressure relief valve 104 disposed in the discharge opening 108. The pressure relief valve 104 is normally closed, and opens when an internal pressure of the reservoir 100 exceeds a predetermined pressure, such as would occur when the user squeezes the reservoir 100. Thus, the pressure relieve valve 104 opens to allow liquid to move from the reservoir 100 to the liquid delivery line 120 when the tool user squeezes the reservoir.

The liquid delivery line 120 is an elongate tube that is located outside the housing 2 and joins the reservoir 100 to the splash guard 80. The liquid delivery line 120 includes a first end 122 that communicates with the reservoir discharge opening 108, and a second end 124 that is opposed to the first end 122. The second end is received in, and secured to, the opening 83 in the splash guard 80. By this configuration, the liquid delivery line 120 permits liquid to be dispensed directly into the space enclosed by the splash guard 80. In the illustrated embodiment, the liquid delivery line second end 124 is angled relative to the rotational axis 26, whereby liquid is dispensed both toward the rotational axis 26 and toward the connector 40. In the illustrated embodiment, the liquid delivery line second end 124 terminates within the splash guard opening 83. However, the liquid delivery line is not limited to this configuration. For example, in some embodiments, the liquid delivery line second end 124 protrudes into the space enclosed by the splash guard 80.

In the illustrated embodiment, the liquid delivery line second end 124 is constituted by the open end of the tube used to form the liquid delivery line 120. In use, the liquid discharged within the splash guard 80 is directed against the connector 40, which is rotating. Thus, even though the dispensing point is fixed relative to the rotational axis 26, the entire tool-facing surface 46 of the connector 40 receives dispensed liquid. In other embodiments, however, the liquid delivery line second end 124 may include baffles (not shown) or other flow disrupters that facilitate a spraying effect within the splash guard 80.

The connector 40 is configured to detachably connect any one of a plurality of different cleaning accessories 60 to the output shaft 24. The cleaning accessories 60 may include, but are not limited to, cleaning pads, sponges, brushes, abrasive pads, polishing cloths, etc. . . . The connector 40 includes a shallow, disc-shaped base 44 and a hollow stem 42 that protrudes from a tool-facing surface 46 of the base 44. An inner surface of the hollow stem 42 includes threads 43 that engage with the output shaft external thread 28, whereby the connector 40 is detachably connected to the output shaft 24 and rotates in concert with the output shaft 24.

The base 44 of the connector 40 includes a planar accessory-facing surface 48 that is opposed to the tool-facing surface 46. The tool-facing surface 46 includes an annular rim 54 that protrudes toward the tool 1 from the tool-facing surface 46. The rim 54 extends along the peripheral edge of the base 44. The tool-facing surface 46 includes protruding ridges 45 that serve both as stiffening gussets and as fluid directing structures. The ridges 45 extend axially along the outer surface of the stein 42 and radially along the tool facing surface 46 between the stein 42 and the rim 54. The ridges 45 are spaced apart from each other.

The base 44 of connector 40 includes circular through-through-openings 52 that extend between the tool-facing surface 46 and the accessory-facing surface 48. An opening 52 is provided between each adjacent pair of ridges 45, and each opening 52 is disposed closer to the rim 54 than to the stem 42. For example, in the illustrated embodiment, the through-through-openings 52 adjoin the rim 54.

The connector 40 includes structural features that direct liquid received from the delivery line 120 to the cleaning accessory 60. The structural features include the through-through-openings 52, which allow the liquid to pass through the base 44 and flow into the cleaning accessory 60. The structural features also include the ridges 45, since the space between adjacent ridges 45 provides a channel that directs liquid toward the through-through-openings 52 in the base 44. In addition, the structural features also include the rim 54, which redirects the liquid that is moving radially outward along the tool-facing surface 46 under centrithgal forces toward the through-through-openings 52. Although the rim 54 is illustrated as protruding in a direction that is parallel to the rotational axis 26, the rim 54 may be inclined inward to facilitate the capture and directing of liquid toward the through-openings 52.

The accessory-facing surface 48 of the connector 40 is configured to niechanically and detachably connect with a cleaning accessory 60. In the illustrated embodiment, the connection is made using a hook and loop fastener, and the accessory-facing surface 48 supports a layer of either hook or loop material. For example, in the illustrated embodiment, a layer of hook material 50 is secured to the accessory-facing surface 48. The layer of hook material may include openings 58 that are aligned with the through-openings 52.

Although the cleaning accessory 60 shown in the illustrated embodiment is a disc-shaped melamine foam pad 62 such as those known under the trademark "Scotch-Brite® Easy Erasing Pad," the cleaning accessory 60 may be any one of many types of cleaning and or polishing devices. As previously mentioned, the cleaning accessory 60 may be selected from the group that includes, but is not limited to, cleaning pads, sponges, brushes, abrasive pads, polishing cloths, and other cleaning or polishing devices. The pad 62 has a diameter that is larger than that of the connector base 44. A connector-facing surface 64 of the pad 62 supports a layer of either hook or loop material. For example, in the illustrated embodiment, the connector-facing surface 64 supports a layer of loop material 56, whereby the cleaning accessory can be detachably connected to the layer of hook material 50 provided on the connector 40. By this connection, the cleaning accessory rotates in concert with the output shaft 24. The cleaning surface 68 of the pad 62 is opposed to the connector-facing surface, and contacts the surface to be cleaned during use.

Figure 6:
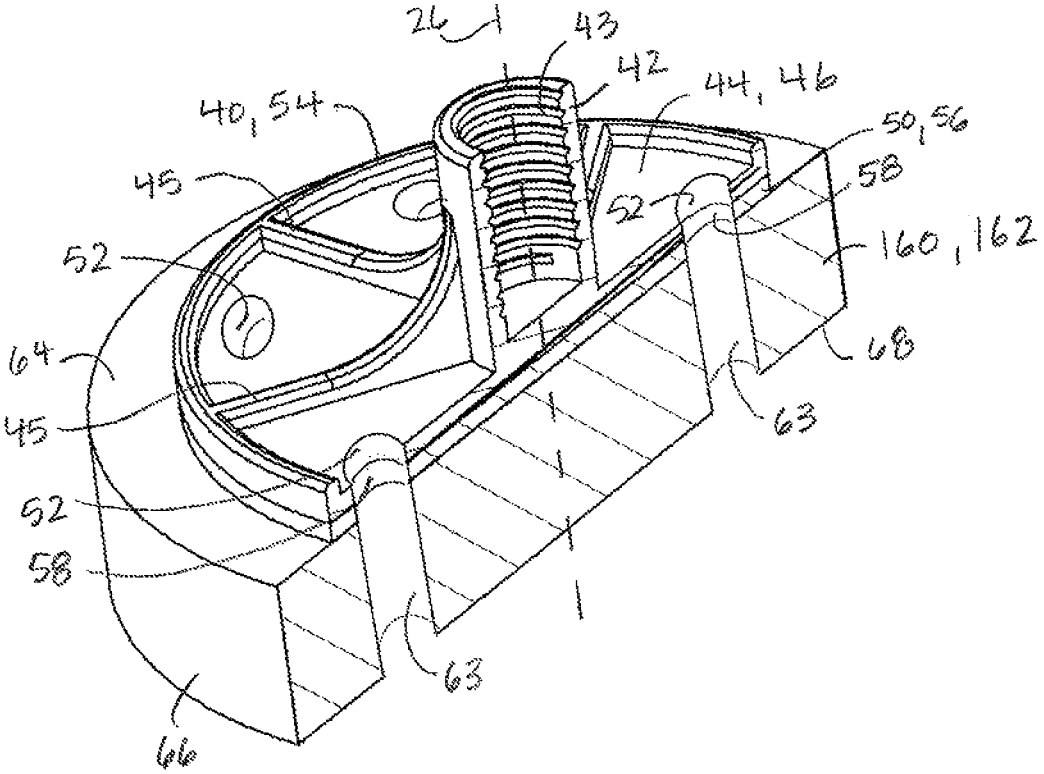
FIG. 6 is a perspective cross-sectional view of the connector of FIG. 2 and an alternative embodiment cleaning accessory.

Referring to FIG. 6, the tool 1 may be used with an alternative embodiment cleaning accessory 160 includes a disc-shaped melamine foam pad 162 that is adapted to permit the liquid distributed from the reservoir 100 to be directed directly to the pad cleaning surface 68. For example, the cleaning accessory 160 is similar to the cleaning accessory 60 described above with respect to FIG. 1-5, and common reference numbers are used to refer to common elements. The cleaning accessory 160 of FIG. 6 differs from the earlier described embodiment in that the pad 162 includes through holes 63 that extend between the connector facing surface 64 and the pad cleaning surface 68. The through holes 63 are each aligned with a conesponding through-opening 52 of the connector base 44.

Figure 7:
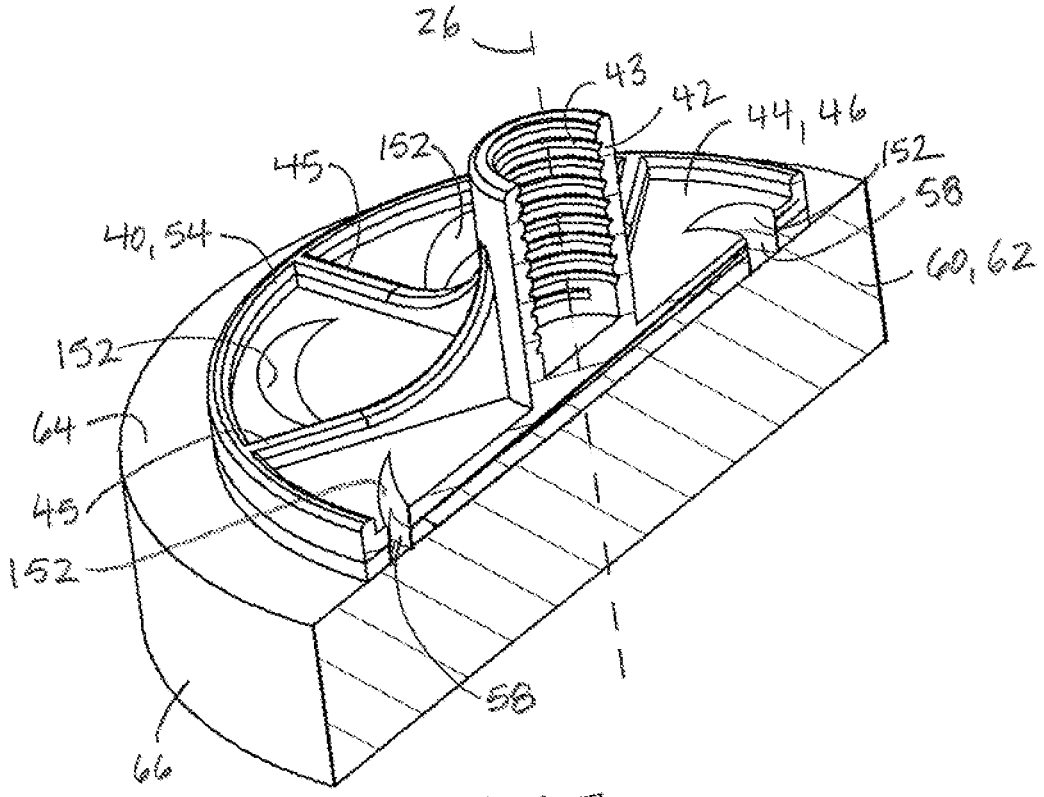
FIG. 7 is a perspective cross-sectional view of an alternative embodiment connector and the cleaning accessory of FIG. 2.
Figure 8:
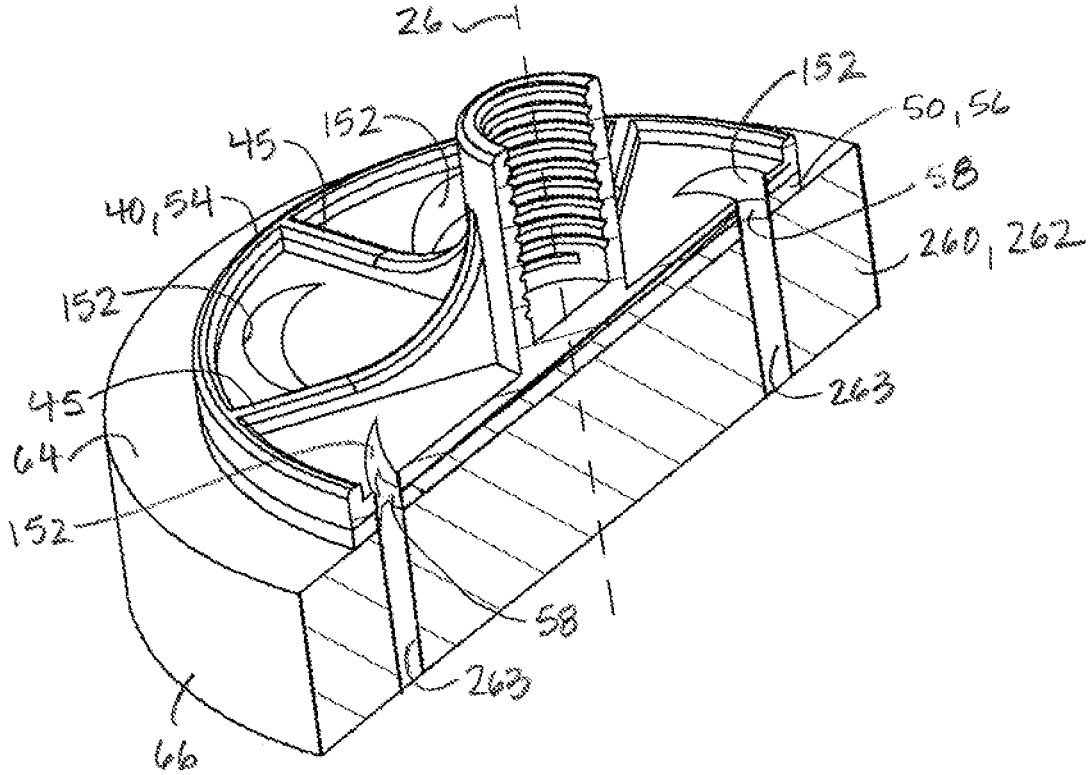
FIG. 8 is a perspective cross-sectional view of the connector of FIG. 7 and an alternative embodiment cleaning accessory.

Referring to FIGS. 7 and 8, the tool 1 may be used with an alternative embodiment connector 140 that is similar to the connector 40 described above with respect to FIGS. 1-5, and common reference numbers are used to refer to common elements. The connector 140 of FIG. 7 differs from the earlier described embodiment in that the connector 140 includes non-circular openings 152. In the illustrated embodiment, the connector 140 includes crescent shaped openings 152, but the openings can have other shapes. For example, in some embodiments, the openings may be elongated, curved slots that extend along the rim 54. In other embodiments, the openings may elongated, linear slots that extend radially between the stein 42 and the rim 54. In still other embodiments, the space between adjacent ridges 45 may include multiple openings. The connector 140 of FIG. 7 may be used with a cleaning accessory 60 including a pad 62 that is free of through holes (FIG. 7) or may be used with another alternative embodiment cleaning accessory 260 having a pad 262 that includes crescent-shaped through holes 263 (FIG. 8).

Figure 9:
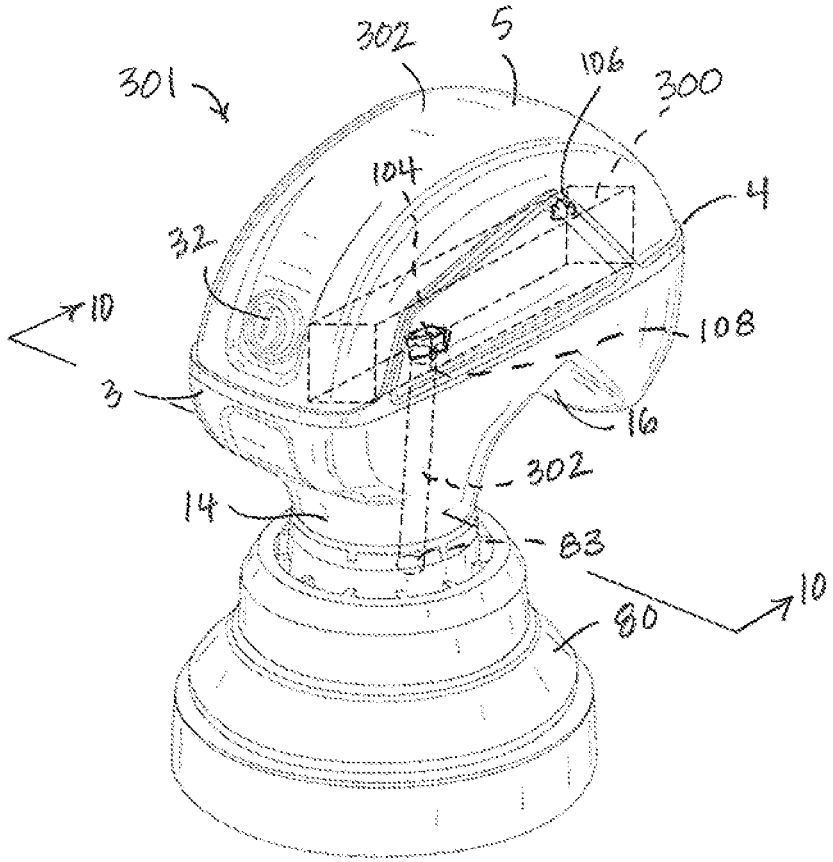
FIG. 9 is a perspective view of an alternative embodiment handheld rotary cleaning tool with an internal reservoir and liquid delivery line shown in broken lines.
Figure 10:
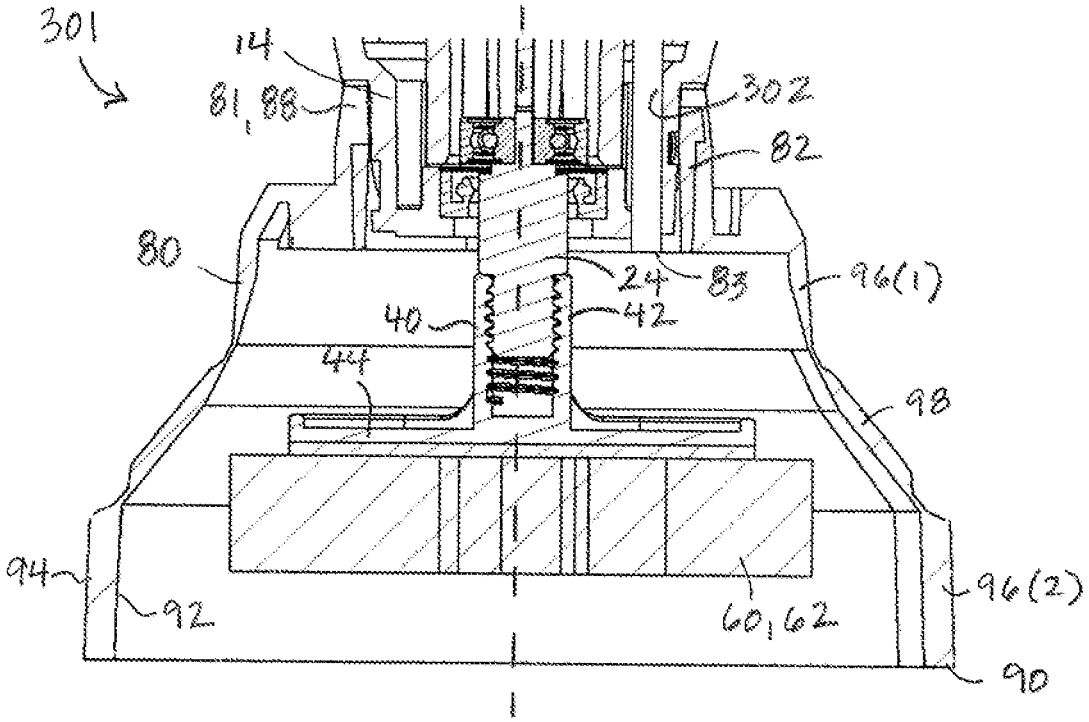
FIG. 10 is a cross-sectional view of a portion of the handheld rotary cleaning tool of FIG. 9 as seen along line 10-10 of FIG. 9.

Referring to FIGS. 9 and 10, although the tool 1 has been described above as including a reservoir 100 that is supported on an external portion of the housing 2, the tool 1 is not limited to this configuration. For example, an alternative embodiment tool 301 may include an alternative housing 302 that axe similar to the tool 1 and housing 2 described above, and common reference numbers are used to refer to common elements. The alternative housing 302 differs from the embodiment described above with respect to FIGS. 1-5 in that it includes an internal reservoir 300 that is connected to the splash guard 80 via a liquid delivery line 320. The internal reservoir 300 is similar to the reservoir 100 described above, and includes a fill opening 106, a discharge opening 108, and a pressure relief valve in the discharge opening 108. The liquid delivery line 320 is disposed in the housing 302 and extends through an opening in the nose terminal end 15. The liquid within the reservoir 300 may be discharged by squeezing the housing 302, whereby pressure is applied to the reservoir 300. It is understood that the tool 301 may include other methods and devices for discharging liquid from the reservoir 300 to the splash guard 80. For example, in some alternative embodiments, the housing 302 may include a lever (not shown) that, when actuated, provides a pumping action such as is found in the handles of conventional spray bottles.

Figure 11:
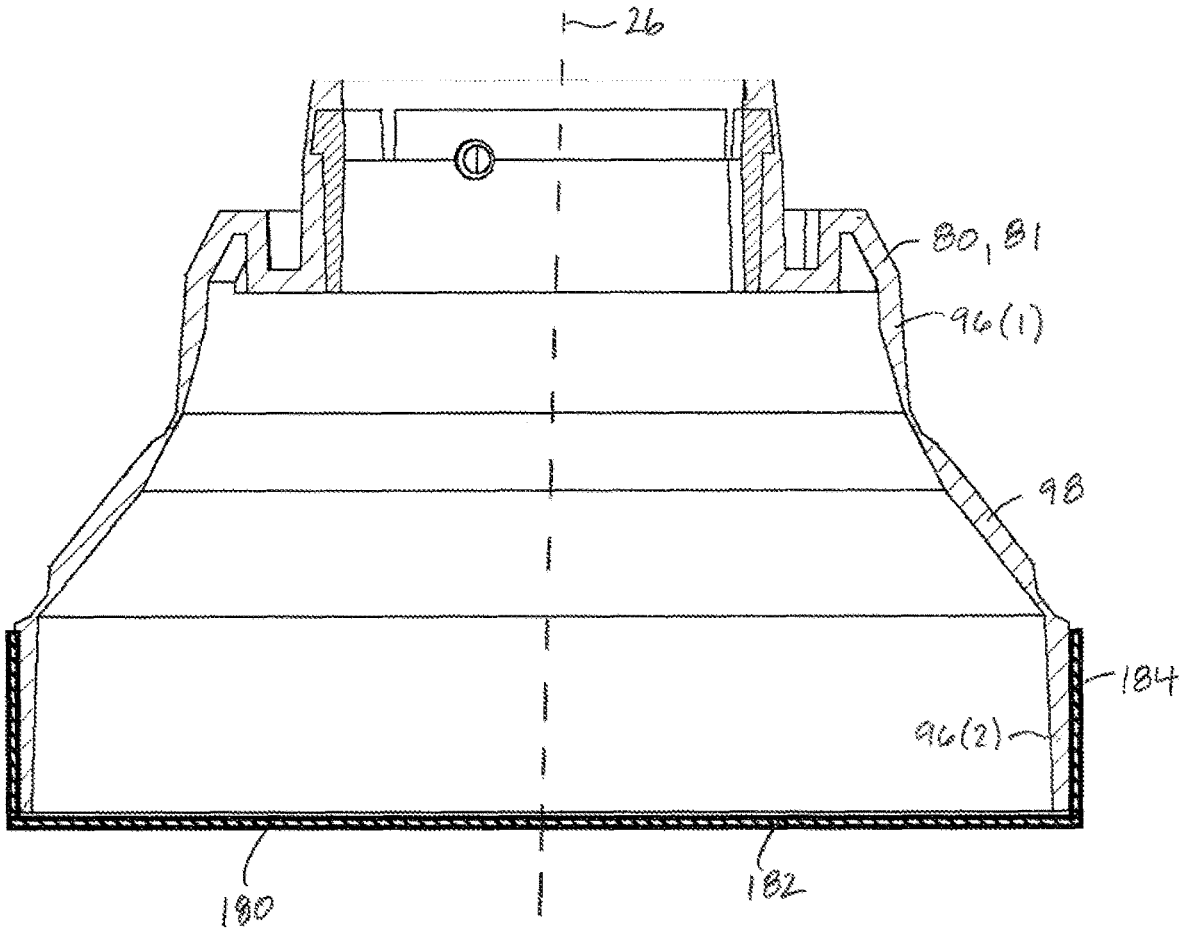
FIG. 11 is a cross-sectional view of the splash guard of FIG. 9 including a cap disposed on the splash guard distal end.

Referring to FIG. 11, the tool 1 may include a cap 180 that may be detachably secured to the distal end 90 of the splash guard body 81. In this example, the cap 180 is a shallow, cup-shaped structure including a closed end 182 that is surrounded by a sidewall 184. An inner diameter of the sidewall 184 is dimensioned to provide a press-fit connection with the outer surface of the second annular region 96(2), whereby the cap 180 can be press fit onto the splash guard 80 and used to close the distal end 90 of the splash guard 80. As a result, the cap 180 can be used to keep the cleaning accessory 60 clean before use, and/or can be used to seal the interior space of the splash guard 280 following use so that the wet and/or soiled cleaning accessory 60 is contained and drips from any residual cleaning solution are avoided.

Although the rotary cleaning tool 1 described above includes a rechargeable battery 18, the tool 1 is not limited to this type of power supply. For example, in some embodiments, the battery 18 is not rechargeable. In other embodiments, the battery 18 is omitted, and the motor 20 is powered by a wired connection to a utility power line.

Although the connector 40 described above forms a detachable mechanical connection with the cleaning accessory 60 via hook and loop fastener, the connector 40 is not limited to this type of connection to the cleaning accessory 60, and any suitable connection may be substituted for the hook and loop fastener. Other suitable connection methods may include magnets, adhesive, snap fasteners, etc.

Although the tool described above includes a reservoir 100, 300, the tool is not limited to this configuration. For example, in some embodiments, the reservoir is omitted, and liquid may be directly and manually added to the splash guard 80 via the splash guard opening 83.

Although the reservoir 100 described above is a flexible bladder, the reservoir 100 is not limited to this configuration. For example, in some embodiments, the reservoir 100 is a rigid container, and the liquid is expelled from the reservoir 100 using conventional fluid driving means such as a manual or electric pump.

Selective illustrative embodiments of the rotary cleaning tool and liquid dispenser are described above in some detail. It should be understood that only structures considered necessary for clarifying the rotary cleaning tool and liquid dispenser have been described herein. Other conventional strictures, and those of ancillary and auxiliary components of the rotary cleaning tool and liquid dispenser, are assumed to be known and understood by those skilled in the art. Moreover, while a working example of the rotary cleaning tool and liquid dispenser have been described above, the rotary cleaning tool and liquid dispenser are not limited to the working examples described above, but various design alterations may be carried out without departing from the rotary cleaning tool and liquid dispenser as set forth in the claims.

We claim:

1. A hand-held rotary cleaning tool, comprising:

a. housing;

a. motor disposed in the housing, the motor configure to rotate an output shaft about a rotational axis, the output shaft protruding from the housing;

a splash guard that is supported on the housing so as to surround a protruding portion of the output shaft;

a reservoir that is configured to receive a liquid, the reservoir supported on the housing; and a liquid delivery line that extends between the reservoir and the splash guard, the liquid delivery line providing a fluid path from the reservoir to the splash guard.

2. The tool of claim 1, wherein the tool comprises a connector that is configured to secure a cleaning accessory to the output shaft, and the connector comprises features that direct liquid received from the delivery line to the cleaning accessory.

3. The tool of claim 2, wherein the features that direct liquid received from the liquid delivery line to the cleaning accessory include ridges that protrude from a tool-facing surface of the connector, the ridges being spaced apart, and each ridge being aligned with a radius of the rotational axis.

4. The tool of claim 2, wherein the features that direct liquid received from the liquid delivery line to the cleaning accessory include a through-opening provided in the connector.

5. The tool of claim 2, wherein the features that direct liquid received from the liquid delivery line to the cleaning accessory include a rim that protrudes from a tool-facing surface of the connector and extends about a periphery of the tool-facing surface.

6. The tool of claim 2, wherein the connector comprises:

a base having a tool-facing surface, an accessory-facing surface that is opposed to the tool-facing surface, and a peripheral edge that extends between the tool-facing surface and the accessory facing surface, a hollow stem that protrudes from a center of the tool-facing surface, the stem being shaped and dimensioned to receive and engage the output shaft, and a through-opening disposed between the stem and the peripheral edge, the through-opening extending between the tool-facing surface and the accessory-facing surface.

7. The tool of claim 6, wherein the connector comprises a pair of protruding ridges that extend between the stem and the peripheral edge, and the through-opening is disposed between the pair of ridges.

8. The tool of claim 6, wherein the connector comprises a rim that protrudes toward the tool from the tool-facing surface, the rim extending along the peripheral edge of the base, and the through-opening is located closer to the rim than to the stem.

9. The tool of claim 8, wherein the through-opening is located adjoining the rim.

10. The tool of claim 6, wherein the tool comprises the cleaning accessory, the cleaning accessory is secured to the accessory-facing surface of the base, and the cleaning accessory includes a through hole that is aligned with the through-opening.

11. The tool of claim 1, wherein the liquid delivery line includes a first end that opens into the reservoir, and a second end that is opposed to the first end, the second end being disposed in the splash guard in such a way that liquid discharged from the second end is directed toward the rotational axis.

12. The tool of claim 1, wherein the reservoir is supported on an outer surface of the housing.

13. The tool of claim 12, wherein the reservoir is a flexible bladder.

14. The tool of claim 12, wherein the reservoir is a flexible bladder that is sized and shaped to be grasped in a user's hand, and includes a pressure relief valve disposed at the interface with the liquid delivery line, the pressure relief valve being normally closed, the pressure relieve valve opening to allow liquid to move from the reservoir to the liquid delivery line when an internal pressure of the reservoir exceeds a predetermined pressure.

15. The tool of claim 1, wherein the liquid delivery line includes a first end that opens into the reservoir, and a second end that is opposed to the first end, the second end being secured in an opening in the splash guard.

16. The tool of claim 15, wherein the second end of the liquid delivery lure protrudes into the space enclosed by the splash guard and opens facing the output shaft.

17. The tool of claim 1, wherein the reservoir is disposed inside the housing.

18. A hand-held rotary cleaning tool, comprising:

a housing;

a motor disposed in the housing, the motor configured to rotate an output shaft about a rotational axis, the output shaft protruding from the housing;

a splash guard that is supported on the housing so as to surround a protruding portion of the output shaft;

a reservoir that is configured to receive a liquid, the reservoir supported on the housing; and a liquid delivery line that extends between the reservoir and the splash guard, the liquid delivery line providing a fluid path from the reservoir to the splash guard, wherein the tool comprises a connector that is configured to secure a cleaning accessory to the output shaft, the connector comprises features that direct liquid received from the delivery line to the cleaning accessory, the features that direct liquid received from the liquid delivery line to the cleaning accessory include ridges that protrude from a tool-facing surface of the connector, the ridges are spaced apart, and each ridge is aligned With a radius of the rotational axis.

19. A hand-held rotary cleaning tool, comprising:

a housing;

a motor disposed in the housing, the motor configured to rotate an output shaft about a rotational axis, the output shaft protruding from the housing;

a splash guard that is supported on the housing so as to surround a protruding portion of the output shaft;

a reservoir that is configured to receive a liquid, the reservoir supported on the housing; and a liquid delivery line that extends between the reservoir and the splash guard, the liquid delivery line providing a fluid path from the reservoir to the splash guard, wherein the reservoir is supported on an outer surface of the housing, and the reservoir is a flexible bladder.

* * * * *